United States Patent [19]

Totani

[11] Patent Number: 4,860,621

[45] Date of Patent: Aug. 29, 1989

[54] HEAT KNIFE HOLDING DEVICE FOR HEAT CUTTING PLASTIC FILMS

[75] Inventor: Mikio Totani, Muko, Japan

[73] Assignee: Totani Giken Kogyo Co., Ltd., Kyoto, Japan

[21] Appl. No.: 183,724

[22] Filed: Apr. 20, 1988

[51] Int. Cl.[4] ..... B26F 3/08

[52] U.S. Cl. ..... 83/171; 219/243; 493/194; 493/209; 493/341; 493/470

[58] Field of Search ..... 83/171, 170, 15; 30/140; 53/373; 219/243; 493/470, 341, 209, 203, 194; 156/515, 583.1, 583.3, 583.4

[56] References Cited

U.S. PATENT DOCUMENTS

| | | | |
|---|---|---|---|
| 1,905,366 | 4/1933 | Carlin | 83/171 |
| 3,157,553 | 11/1964 | Spallina | 83/171 X |
| 3,415,704 | 12/1968 | Bate | 156/515 |
| 3,574,039 | 4/1971 | Fehr et al. | 156/515 |
| 3,916,148 | 10/1975 | La Fleur | 219/243 |
| 4,449,962 | 5/1984 | Copia | 156/583.1 |

OTHER PUBLICATIONS

"Side Weld Bag Making Machine", undated, published by Totani Giken Kogyo Co., Ltd.

*Primary Examiner*—Frank T. Yost
*Assistant Examiner*—Rinaldi Rada
*Attorney, Agent, or Firm*—Morgan & Finnegan

[57] ABSTRACT

According to the invention, a heat knife 1 is spaced from and disposed parallel to an arm 8 for holding the heat knife 1. A plurality of spacers 11 and a plurality of pull bolts 10 are installed between the heat knife 1 and the arm 8. The pull bolts 10 is adapted to connect the heat knife 1 to the arm 8 and pull the heat knife 1 toward the arm 8 to reduce the distance therebetween and clamp the spacers 11 between the heat knife 1 and the arm 8, whereby the heat knife 1 and the arm 8 are held parallel to each other.

10 Claims, 2 Drawing Sheets

HEAT KNIFE HOLDING DEVICE FOR HEAT CUTTING PLASTIC FILMS

FIELD OF THE INVENTION

This invention relates to an apparatus for heat cutting plastic films by a heat knife, and particularly to a heat knife holding device therefor.

PRIOR ART

For example, in a process for producing bags by using a plastic film, a system using a heat knife to heat cut the plastic film has been generally employed. The plastic film is directed to and folded in two by a triangular plate and then passed between a heat knife and an opposed member. The heat knife has a heater contained therein to heat the heat knife to 300°-500° C. The plastic film is nipped between the heat knife and the opposed member and heat cut by the heat knife. Thus, bags can be continuously produced from the plastic film.

In this apparatus, for uniform heat cutting of the plastic film over the entire width thereof, it is necessary to arrange the heat knife and the opposed member in parallel relation to each other so that the heat knife is properly pressed against the plastic film. In addition, it is preferable that the linearity of the edge of the heat knife is maintained even if heat knife is heated to 300°-500° C. Heretofore, an arm in the form of a square steel or shape steel has been used for holding the heat knife. The heat knife is fixed to the lower surface of the arm. However, when the heat knife is heated to 300°-500° C., a thermal expansion takes place in the heat knife. Further, the heat in the heat knife is transmitted to the arm, causing a thermal expansion in the portion thereof adjacent the heat knife. Therefore, the heat knife and the arm inevitably curve. As a result, it is impossible to obtain the linearity of the edge of the heat knife and the parallelism between the heat knife and the opposed member, so that the plastic film can not be heat cut uniformly over the entire width thereof.

SUMMARY OF THE INVENTION

Accordingly, an object of the invention is to provide a novel and improved heat knife holding device which solves the problem inherent in the prior art described above.

Another object of the invention is to provide a novel and improved heat knife holding device which maintains the linearity of the edge of the heat knife and the parallelism between the heat knife and the opposed member, thus making it possible to heat cut a plastic film uniformly over the entire width thereof.

According to the invention, a heat knife is spaced from and disposed parallel to an arm for holding the heat knife. A plurality of spacers and a plurality of pull bolts are installed between the heat knife and the arm. The pull bolts are adapted to connect the heat knife to the arm and pull the heat knife toward the arm to reduce the distance therebetween and clamp the spacers between the heat knife and the arm, whereby the heat knife and the arm are held parallel to each other.

When a thermal expansion takes place in the heat knife, the pull bolts and spacers slightly tilt between the heat knife and the arm in response to the thermal expansion of the heat knife. Even if the suspension bolts and spacers slightly tilt, there is little change taking place in the distance between the heat knife and the arm. Even if this distance should change, the amount of change would be negligibly small. It is also possible to ensure the distance between the heat knife and the arm does not change at all. Therefore, irrespective of thermal expansion of the heat knife, the linearity of the edge of the heat knife and the parallelism between the heat knife and the arm can be maintained and the plastic film can be heat cut uniformly over the entire width thereof.

DESCRIPTION OF THE PREFERRED EMBODIMENT

Figure 1:
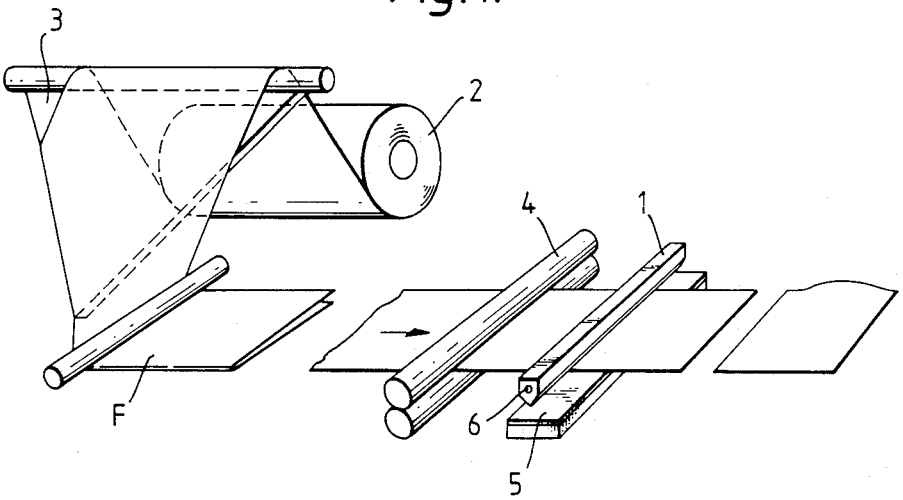
FIG. 1 is a schematic view showing an apparatus according to the invention.

Referring to FIG. 1, there is shown an apparatus for producing bags by using a plastic film F. The apparatus includes a heat knife 1 to heat cut the plastic film F. The plastic film F is unwound from a roll 2 and directed to a triangular plate 3 and a pair of nip rollers 4 so that the plastic film F is folded in two by the triangular plate 3 and interposed between and intermittently fed by the nip rollers 4. The plastic film F is then passed between the heat knife 1 and an opposed member 5. The heat knife 1 has a heater 6 contained therein to heat the heat knife 1 to 300°-500° C. The opposed member 5 is made of a heat resistant material, such as silicone rubber. Therefore, by intermittently feeding the plastic film F and depressing the heat knife 1, the plastic film F is nipped between the heat knife 1 and the opposed member 5 and heat cut by the heat knife 1. Thus, bags can be continuously produced from the plastic film F.

Figure 2:
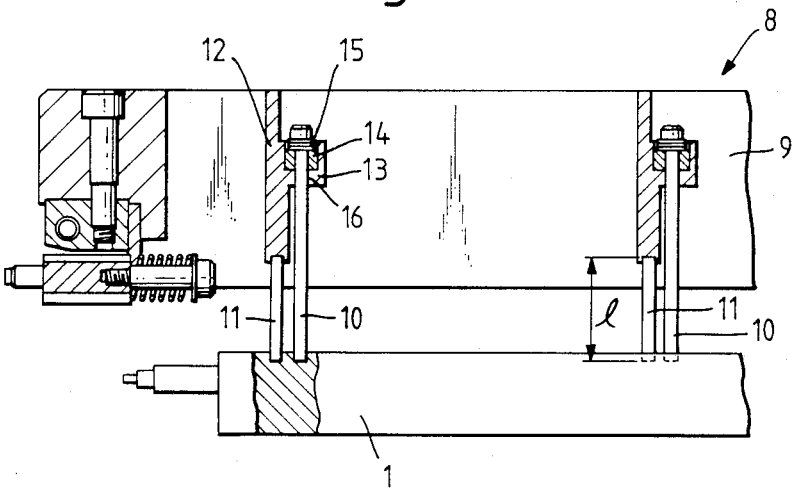
FIG. 2 is a sectional view showing a device for holding a heat knife of FIG. 1.
Figure 3:
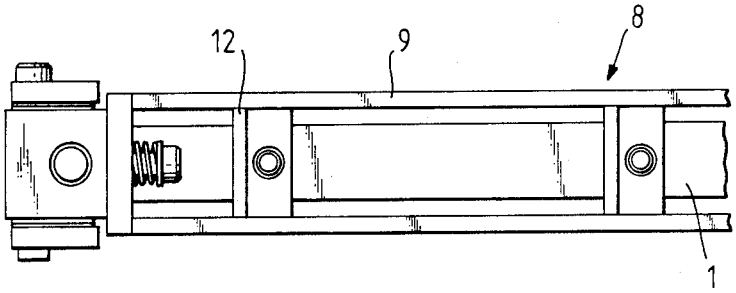
FIG. 3 is a plan view of a heat knife holding device of FIG. 2.
Figure 4:
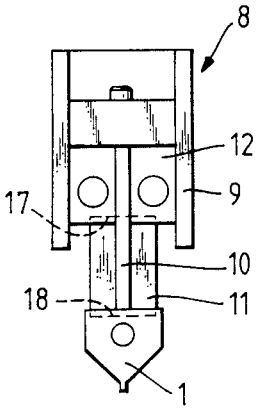
FIG. 4 is a front view of the heat knife holding device of FIG. 2.

Referring to FIG. 2, there is shown a device having a heat knife 1 and an arm 8 for holding the heat knife 1 according to the invention. The heat knife 1 extends horizontally and spaced from and disposed parallel to the arm 8. The heat knife 1 is similar to the one shown in FIG. 1, having a heater 6 contained wherein to heat the heat knife 1 to 300°-500° C. The arm 8 also extends horizontally and has a pair of side plates 9. A plurality of pull bolts 10 and a plurality of spacers 11 are installed between the heat knife 1 and the arm 8.

In this embodiment, a plurality of bridge plates 12 are provided between the side plates 9 of the arm 8, the bridge plates 12 being spaced to each other longitudinally of the arm 8 and fixed to the side plates 9. Each bridge plate 12 has a flange 13, a collar 14 and a coned disc spring 15, the collar 14 and the coned disc spring 15 being received in a recess formed in the flange 13. The flange 13 has a through-hole 16 larger in diameter than the pull bolt 10. Each pull bolt 10 is inserted through the coned disc spring 15, collar 14 and through-hole 16 and threadedly engaged with the threaded hole in the heat knife 1. Thereby, the heat knife 1 is connected to the arm 8.

Figure 5:
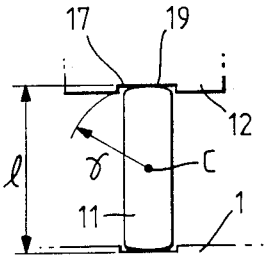
FIG. 5 is an explanatory view showing another embodiment.

The spacers 11 are made of ceramic materials and take the form of plates, having the same length 1 and positioned to extend vertically. As shown in FIG. 5, each spacer has a rectangular shape with a given width and has opposite ends received in a groove 17 formed in the bridge plate 12 and a groove 18 formed in the heat knife 1. Therefore, when the pull bolts 10 are tightened, the heat knife 1 is pulled up toward the arm 8 by the pull bolts 10, so that the distance between the heat knife 1 and the arm 8 is reduced. Therefore, the spacers 11 are pressed into the grooves 17 in the bridge plates 12 and the grooves 18 in the heat knife 1 and clamped between the heat knife 1 and the arm 8, whereby the heat knife 1 can be held parallel to the arm 8. The distance between them is determined by the vertical length 1 of the spacer 11.

In the device constructed in the manner described above, when the heat knife 1 is heated to 300°-500° C. and a thermal expansion takes place in the heat knife 1, the pull bolts 10 and spacers 11 slightly tilt between the heat knife 1 and the arm 8 in response to the thermal expansion of the heat knife 1. The pull bolts 10 are slightly deformed with the coned disc springs 15 elastically deformed to allow the tilting of the pull bolts 10. As for the spacers 11, the opposite ends thereof are turned in the grooves 17 and 18 to allow the tilting of the spacers 11.

Therefore, when a thermal expansion takes place in the heat knife 1, the arm 8 does not curve. Further, even if the pull bolts 10 and spacers 11 slightly tilt, there is little change occurring in the vertical length 1 of the spacers 11. Accordingly, there is little change in the distance between the heat knife 1 and the arm 8. Even if this distance should change, the amount of change would be negligibly small. Accordingly, the heat knife 1 does not tilt and does not curve. The linearity of the edge of the heat knife 1 and the parallelism between the heat knife and the opposed member 5 can be maintained.

Therefore, when the heat knife 1 and the arm 8 are depressed, the plastic film F is nipped between the heat knife 1 and the opposed member 5, with the heat knife 1 properly pressed against the plastic film F. The plastic film F is heat cut uniformly over the entire width thereof.

Referring to FIG. 5, another embodiment is shown. In this embodiment, the opposite ends of each spacer 11 are curved to form curved surfaces 19 extending along part of the circumference of a circle with a given radius r around the center C of the spacer 11, and turned in the grooves 17 and 18 in the bridge plate 12 and heat knife 1 around the center C of the spacer 11 when the spacer 11 slightly tilts, so that the vertical distance 1 does not change at all. Therefore, the distance between the heat knife 1 and the arm 8 does not change at all.

As has been described so far, according to the invention, even if a thermal expansion takes place in the heat knife, the linearity of the edge of the heat knife and the parallelism between the heat knife and the opposed member can be maintained. Therefore, the plastic film can be heat cut uniformly over the entire width thereof.

What is claimed is:

1. A heat knife holding device comprising a heat knife, an arm for holding said heat knife, said heat knife being spaced from and disposed parallel to said arm, a plurality of spacers disposed between said heat knife and said arm, and a plurality of pull bolts disposed between said heat knife and said arm for connecting said heat knife to said arm, said pull bolts pulling said knife toward said arm to reduce the distance therebetween and clamp said spacers between said heat knife and said arm, whereby said heat knife and said arm are held parallel to each other, said heat knife extending horizontally and having a heater contained therein to heat said knife to 300° C.-500° C., said arm including a pair of side plates and a plurality of bridge plates disposed between said side plates, said bridge plates being spaced from each other along said arm and fixed to said side plates.

2. A heat knife holding device as set forth in claim 2, wherein said spacers are made of ceramic materials and take the form of plates having the same length, extending vertically and having opposite ends received in grooves formed in said bridge plates and grooves formed in said heat knife when said spacers are clamped between said heat knife and said bridge plates of said arm.

3. A heat knife holding device as set forth in claim 22, wherein each of said bridge plates has a flange, a collar and a coned disc spring, said flange having a recess for receiving said collar and said coned disc spring and a through-hole of larger diameter than that of said pull bolt, said pull bolt being inserted through said coned disc spring, said collar and said through-hole, whereby said heat knife is connected to said arm.

4. A heat knife holding device as set forth in claim 3, wherein each of said spacers has curved surfaces formed on the opposite ends thereof, said curved surfaces extending along part of the circumference of a circle with a given radius around the center of said spacer, so that even if said spacer slightly tilts, the vertical distance therealong does not change at all.

5. A heat knife holding device comprising a heat knife, an arm for holding said knife, said heat knife being spaced from and disposed parallel to said arm, a plurality of spacers disposed between said heat knife and said arm, and a plurality of pull bolts disposed between said heat knife and said arm for connecting said heat knife to said arm, said pull bolts pulling said heat knife toward said arm to reduce the distance therebetween and clamp said spacers between said heat knife and said arm, said heat knife and said arm extending horizontally, said spacers taking the form of plates having substantially the same length, extending vertically and having opposite ends, said heat knife and said arm including grooves configured and dimensioned to receive said opposite ends of said spacers when said spacers are clamped between said heat knife and said arm so that said spacers can tilt slightly between said heat knife and said arm in response to the thermal expansion of said heat knife, the vertical length of said spacers remaining substantially unchanged in the event said spacers tilt, whereby said heat knife and said arm are held parallel to each other notwithstanding thermal expansion of said arm.

6. A heat knife holding device as set forth in claim 5, wherein each said spacer is thin in the longitudinal direction of said arm relative to the vertical length of said spacer, so that the vertical length of said spacer remains substantially unchanged should said spacer tilt slightly.

7. A heat knife holding device as set forth in claim 5, wherein each said spacer has curved surfaces formed on the opposite ends thereof, said curved surfaces extending along part of the circumference of a circle with a given radius around the center of said spacer, so that the vertical length of said spacer remains substantially unchanged should said spacer tilt slightly.

8. A heat knife holding device as set forth in claim 7, wherein said heat knife has a heater contained therein to heat said knife to 300° C.-500° C.

9. A heat knife holding device as set forth in claim 9, wherein said spacers are made of ceramic materials.

10. A heat knife holding device as set forth in claim 9, wherein said arm comprises a pair of side plates and a plurality of bridge plates disposed between said side plates, said bridge plates being spaced from each other along said arm and fixed to said side plates, said grooves of said arm being formed in said bridge plates.

* * * * *